US010371387B2

(12) United States Patent
Thomas

(10) Patent No.: US 10,371,387 B2
(45) Date of Patent: Aug. 6, 2019

(54) COOKING APPLIANCE AND METHOD OF REDUCING COOKING APPLIANCE CONSOLE TEMPERATURE

(71) Applicant: Whirlpool Corporation, Benton Harbor, MI (US)

(72) Inventor: Jack R. Thomas, Jenks, OK (US)

(73) Assignee: Whirlpool Corporation, Benton Harbor, MI (US)

( * ) Notice: Subject to any disclaimer, the term of this patent is extended or adjusted under 35 U.S.C. 154(b) by 351 days.

(21) Appl. No.: 15/228,132

(22) Filed: Aug. 4, 2016

(65) Prior Publication Data

US 2018/0038595 A1 Feb. 8, 2018

(51) Int. Cl.
*F24C 15/00* (2006.01)
*F24C 15/20* (2006.01)

(52) U.S. Cl.
CPC ..... *F24C 15/006* (2013.01); *F24C 15/2007* (2013.01)

(58) Field of Classification Search
CPC . F24C 15/006; F24C 15/2007; F24C 15/2021
See application file for complete search history.

(56) References Cited

U.S. PATENT DOCUMENTS 4,241,718 A 12/1980 Barnett
4,373,504 A 2/1983 Day
4,392,038 A 7/1983 Day et al.
4,430,541 A 2/1984 Day, Jr.
4,598,691 A * 7/1986 Herrelko ..... F24C 15/2007 126/19 R
5,215,073 A 6/1993 Wilson
5,474,055 A 12/1995 Kang
6,172,338 B1 6/2001 Barnes et al.
6,761,159 B1 * 7/2004 Barnes ..... F24C 15/2007 126/15 R
8,450,656 B2 5/2013 Doyal et al.
9,021,942 B2 5/2015 Lee et al.
2014/0290641 A1 * 10/2014 Worrell ..... F24C 15/2078 126/299 D
2015/0260413 A1 9/2015 Chadwick et al.
2015/0260415 A1 9/2015 Chadwick et al.
2016/0327283 A1 * 11/2016 Lee ..... F24C 3/124

* cited by examiner

*Primary Examiner* — Gregory L Huson
*Assistant Examiner* — Brandon Nelan
(74) *Attorney, Agent, or Firm* — Diederiks & Whitelaw, PLC.

(57) ABSTRACT

A cooking appliance comprises a cooktop, an oven cavity and a console. The console includes a user interface for the cooking appliance. Air exiting the oven cavity passes through a flue, and a deflector reduces heat transfer between this air and the console. The cooking appliance further comprises a back panel including a first hole. Air traveling along a first airflow path defined by the cooking appliance exits the flue and is deflected rearward through the first hole by the deflector.

18 Claims, 6 Drawing Sheets

COOKING APPLIANCE AND METHOD OF REDUCING COOKING APPLIANCE CONSOLE TEMPERATURE

BACKGROUND OF THE INVENTION

The present invention pertains to cooking appliances and, more particularly, to reducing the temperature of a control console of a cooking appliance.

Typically, flue gases generated in a cooking appliance, such as a free-standing range, pass by a console, which contains a user interface for the cooking appliance, before exiting through a front portion of the cooking appliance underneath the console. Most often, there is no separation provided between the body of the cooking appliance and the console such that the console is directly heated by the flowing flue gases. In some designs, a deflector can be employed to re-direct flue gases, resulting in only indirect heating of consoles. Still, there is a need in the art for a way to reduce the temperature of a console of a cooking appliance.

SUMMARY OF THE INVENTION

The present invention is directed to a cooking appliance comprising a cooktop, an oven cavity and a console. The console includes a user interface for the cooking appliance. Air exiting the oven cavity passes through a flue, and is re-directed by a deflector, thereby reducing heat transfer between this air and the console. The cooking appliance further comprises a back panel including a first hole. Air traveling along a first airflow path defined by the cooking appliance exits the flue and is deflected rearward through the first hole by the deflector.

In one embodiment, the deflector includes an upper wall, a lower wall and a duct defined between the upper wall and the lower wall. Air traveling along the first airflow path exits the flue and is deflected rearward through the first hole by the lower wall of the deflector. The back panel further includes a second hole. Air traveling along a second airflow path defined by the cooking appliance enters the duct through a gap located between the cooktop and the console before passing through the second hole. Air traveling along the first airflow path travels upward along the back panel after passing through the first hole, and air traveling along the second airflow path travels upward along the back panel after passing through the second hole. The first hole is located below the second hole such that the air traveling along the first airflow path mixes with the air traveling within the second airflow path along the back panel.

In another embodiment, the duct is located above the flue, between the flue and the console, while the deflector is directly coupled to the console and the back panel.

In still another embodiment, the cooking appliance further comprises a diffuser. Air traveling along the first airflow path impinges on and then passes around or through the diffuser before being deflected rearward by the deflector. The diffuser is configured to disperse air traveling along the first airflow path along the width of the cooking appliance. In addition, the cooking appliance further comprises a body. Air traveling along a third airflow path defined by the cooking appliance travels upward from an area defined between the body and the back panel, impinges on the diffuser, which is directly coupled to the deflector, and mixes with the air traveling along the first airflow path.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE PREFERRED EMBODIMENTS

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to employ the present invention.

Figure 1:
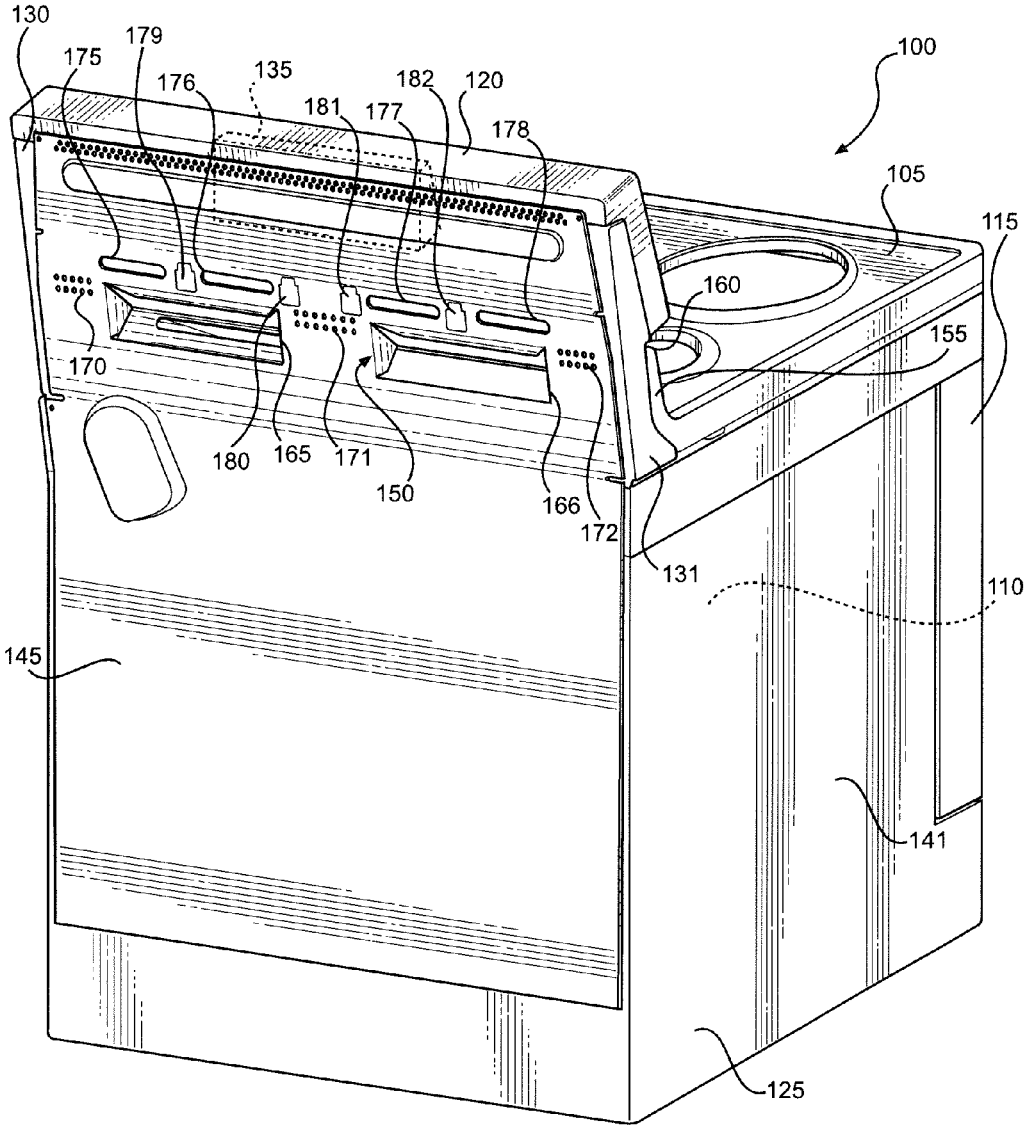
FIG. 1 is a rear perspective view of a cooking appliance constructed in accordance with the present invention.

With initial reference to FIG. 1, there is shown a cooking appliance 100 constructed in accordance with the present invention. As shown, cooking appliance 100 is a gas or electric free-standing range including a cooktop 105 and an oven cavity 110. Although not shown, cooktop 105 typically includes a plurality of burners for heating cooking utensils placed thereon (e.g., pots or pans). Similarly, oven cavity 110 typically includes heating elements for heating oven cavity 110 and objects placed therein (e.g., baking sheets or dishes). Oven cavity 110 is selectively sealed by a door 115. Cooking appliance 100 further includes a console 120, which is coupled to a body 125 of cooking appliance 100 by upstanding legs 130 and 131. A user interface 135 is provided in console 120. User interface 135 is an electronic interface, typically including at least a display screen and one or more buttons. In certain arrangements, user interface 135 further includes a plurality of knobs for controlling the burners. Alternatively, the knobs are provided near the front of cooktop 105 above door 115 and therefore constitute a second user interface. Cooking appliance 100 also includes side panels 140 and 141 and a back panel 145 that serve to cover various internal components of cooking appliance 100. In addition, back panel 145 helps define certain air flow paths, as will be discussed below. Along these lines, a plurality of holes (collectively labeled 150) is provided in back panel 145. The function of holes 150 will also be described below.

As discussed above, in a typical prior art cooking appliance, hot air generated in the cooking appliance through use of an oven cavity passes under a console and is exhausted through a front portion of the cooking appliance underneath the console. Although cooking appliance 100 does not function in this manner, for the sake of a fuller explanation, such an arrangement would involve hot air generated within cooking appliance 100 during use of oven cavity 110 passing through the area defined by back panel 145, legs 130 and 131 and a rear wall 155 of cooktop 105. The air would then exit through a gap 160 located between console 120 and rear wall 155 such that the air exhausts through the front of cooking appliance 100.

Figure 2A:
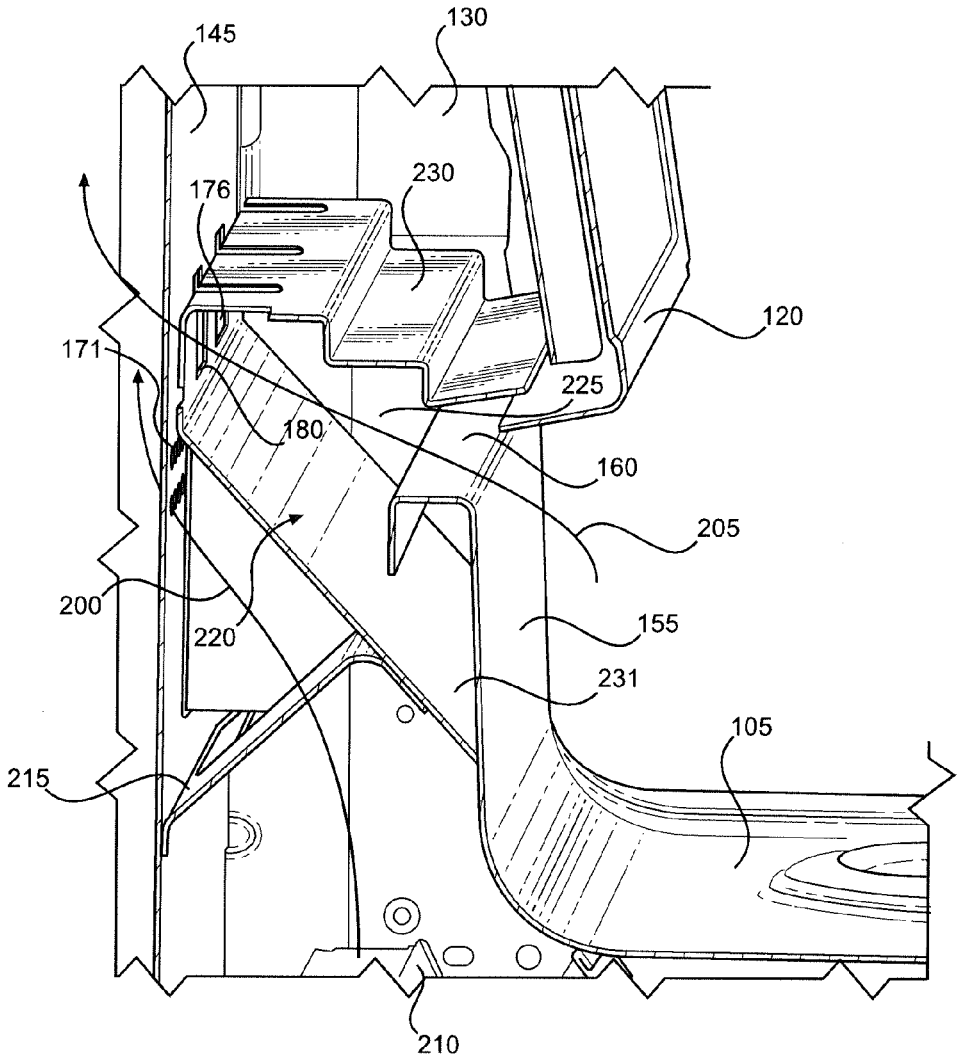
FIG. 2A is a cross section of the cooking appliance.
Figure 2B:
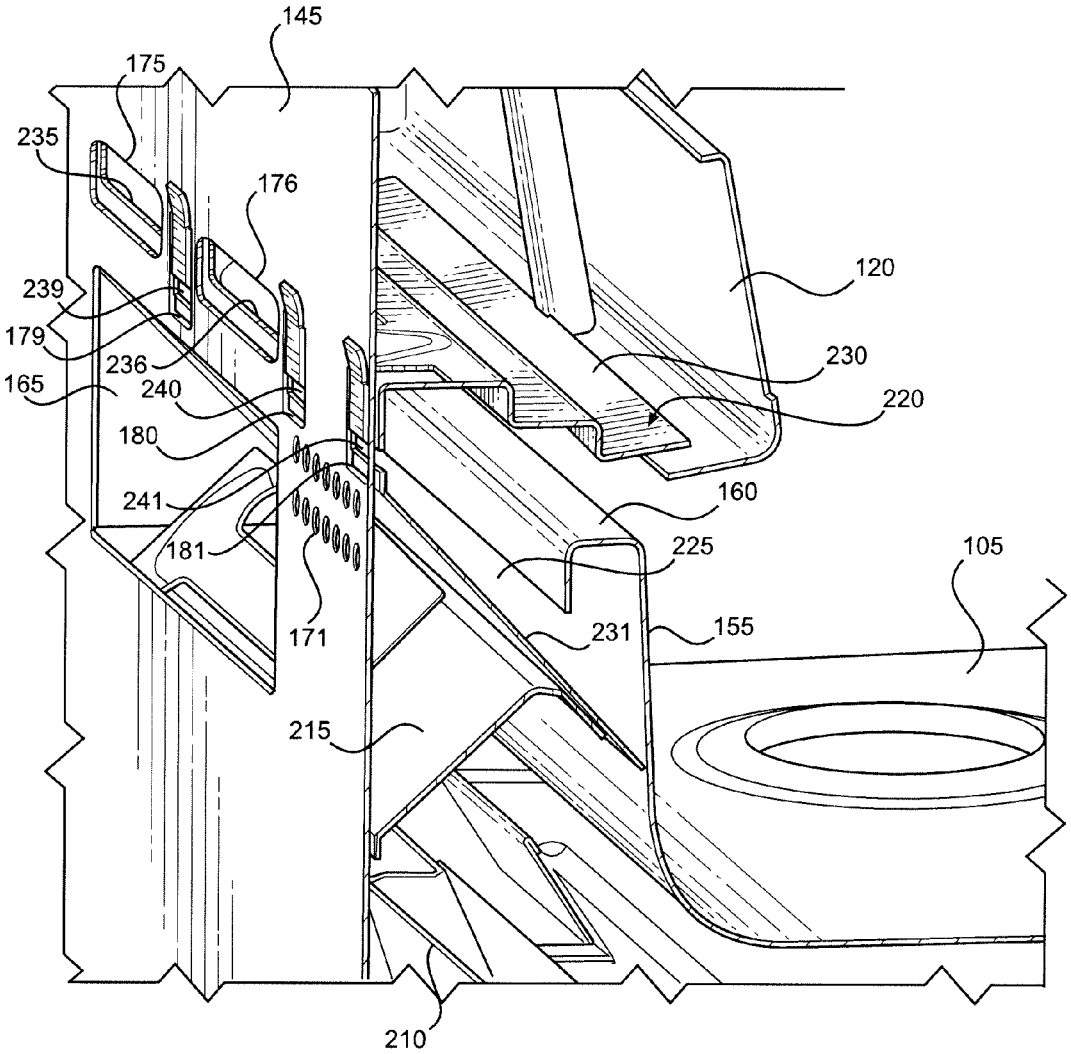
FIG. 2B is another cross section of the cooking appliance.

In the present invention, however, this is not the case. Instead, hot air generated within cooking appliance 100, and more specifically within oven cavity 110, is exhausted through holes 165 and 166 and sets of holes 170-172 (all part of holes 150), while a cooling airflow is drawn into gap 160 and passes rearward through holes 175-182 (also part of holes 150). This is most easily seen in FIGS. 2A and 2B. Specifically, FIGS. 2A and 2B show a first airflow path 200 and a second airflow path 205. The hot air generated in oven cavity 110 exits oven cavity 110 through a flue 210 and travels along first airflow path 200. That is, the air travels upward and passes through a diffuser (or dispersion plate) 215, at which point the air is deflected by a console heat deflector 220. The air then passes through through holes 165 and 166 and sets of holes 170-172 and travels upward along back panel 145. The stack (or chimney) effect resulting from the flow of hot air along first airflow path 200 causes the relatively cooler air located above cooktop 105, as well as a cooler airflow from below cooking appliance 100, to be drawn along second airflow path 205. That is, the air above cooktop 105 is drawn into and passes through gap 160 to prevent a build-up of heat under console 120 and then through a duct 225 defined between an upper wall 230 and a lower wall 231 of deflector 220. Next, the air passes through holes 235-242 provided in deflector 220 and holes 175-182, which are aligned with holes 235-242. The air then travels upward along back panel 145, thereby mixing with the hot air of first airflow path 200 and beneficially lowering the overall temperature of the air in this region. As a result of this arrangement, not only is console 120 protected from direct contact with the hot air traveling along first airflow path 200, but the relatively cooler air traveling along second airflow path 205 serves as an additional buffer. Accordingly, the temperature of console 120 is significantly reduced relative to that of the prior art console described above.

Figure 3:
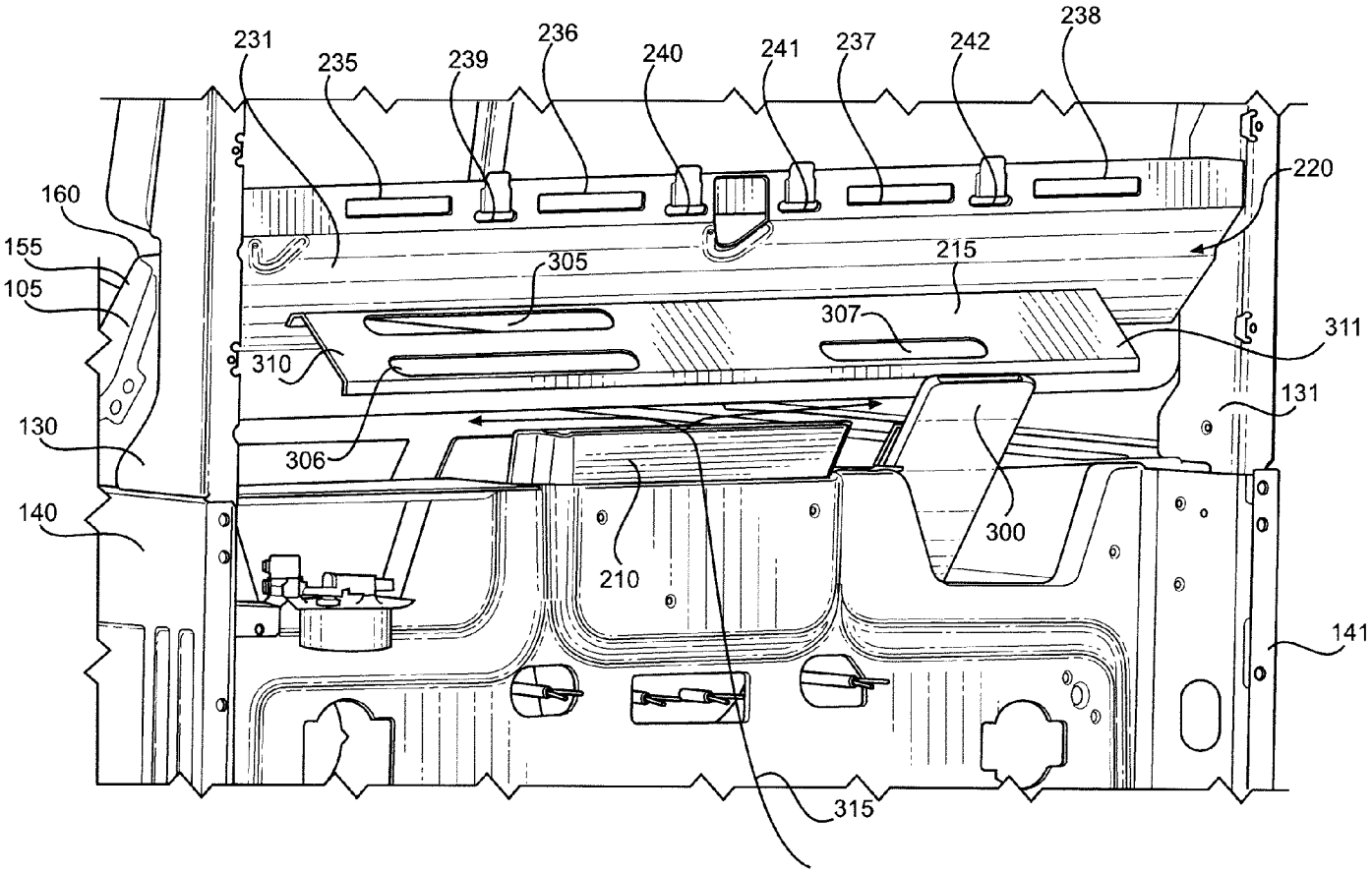
FIG. 3 is rear perspective view of the cooking appliance with a back panel removed.

With reference now to FIG. 3, cooking appliance 100 is shown with back panel 145 removed. In addition to flue 210, a flue 300 can be seen. Although two flues are shown, it should be recognized that in practice only one of flues 210, 300 is present. Specifically, flue 210 is used when cooking appliance 100 is a gas range, and flue 300 is used when cooking appliance 100 is an electric range. Otherwise, flues 210 and 300 function in the same manner. That is, each of flues 210, 300 allows hot air generated in oven cavity 110 to exit oven cavity 110. The hot air exiting flue 210 or flue 300 impinges on diffuser 215, which causes the air to spread out along the length of diffuser 215 in a direction perpendicular to the air's previous direction of travel. Accordingly, the hot air is also dispersed along the full width of cooking appliance 100 (i.e., substantially from leg 130 to leg 131). Once dispersed, the air mixes with the cooler air from below and then passes through holes 305-307 provided in diffuser 215 and around ends 310 and 311 of diffuser 215 before being deflected rearward by lower wall 231 of deflector 220. The air then exits cooking appliance 100 through holes 165 and 166 and through sets of holes 170-172 provided in back panel 145. This arrangement helps prevent the formation of a single hotspot behind cooking appliance 100 aligned with flue 210 or flue 300. In addition, the stack effect will cause relatively cooler air to be drawn from the lower portions of cooking appliance 100 (e.g., the space between back panel 145 and body 125) up through and around diffuser 215. The mixing of such air with the hot air exiting flue 210 or flue 300 drastically reduces the temperature of the air exiting the rear of cooking appliance 100. In particular, FIG. 3 shows a third airflow path 315. Air traveling along third airflow path 315 is drawn through the area defined between body 125 and back panel 145, impinges on diffuser 215 and mixes with the air traveling along first airflow path 200.

Figure 4A:
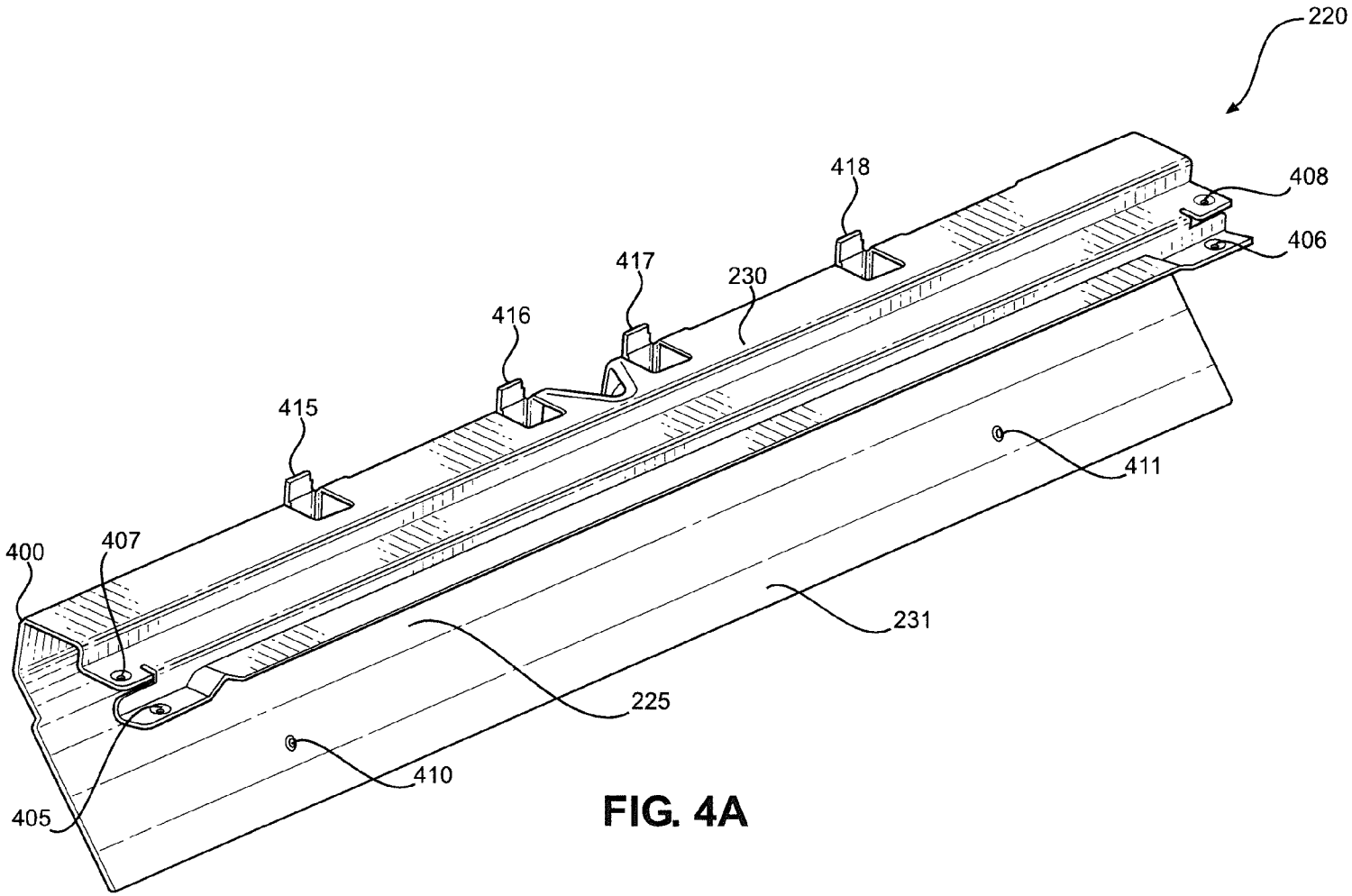
FIG. 4A is a rear perspective view of a console heat deflector constructed in accordance with the present invention.
Figure 4B:
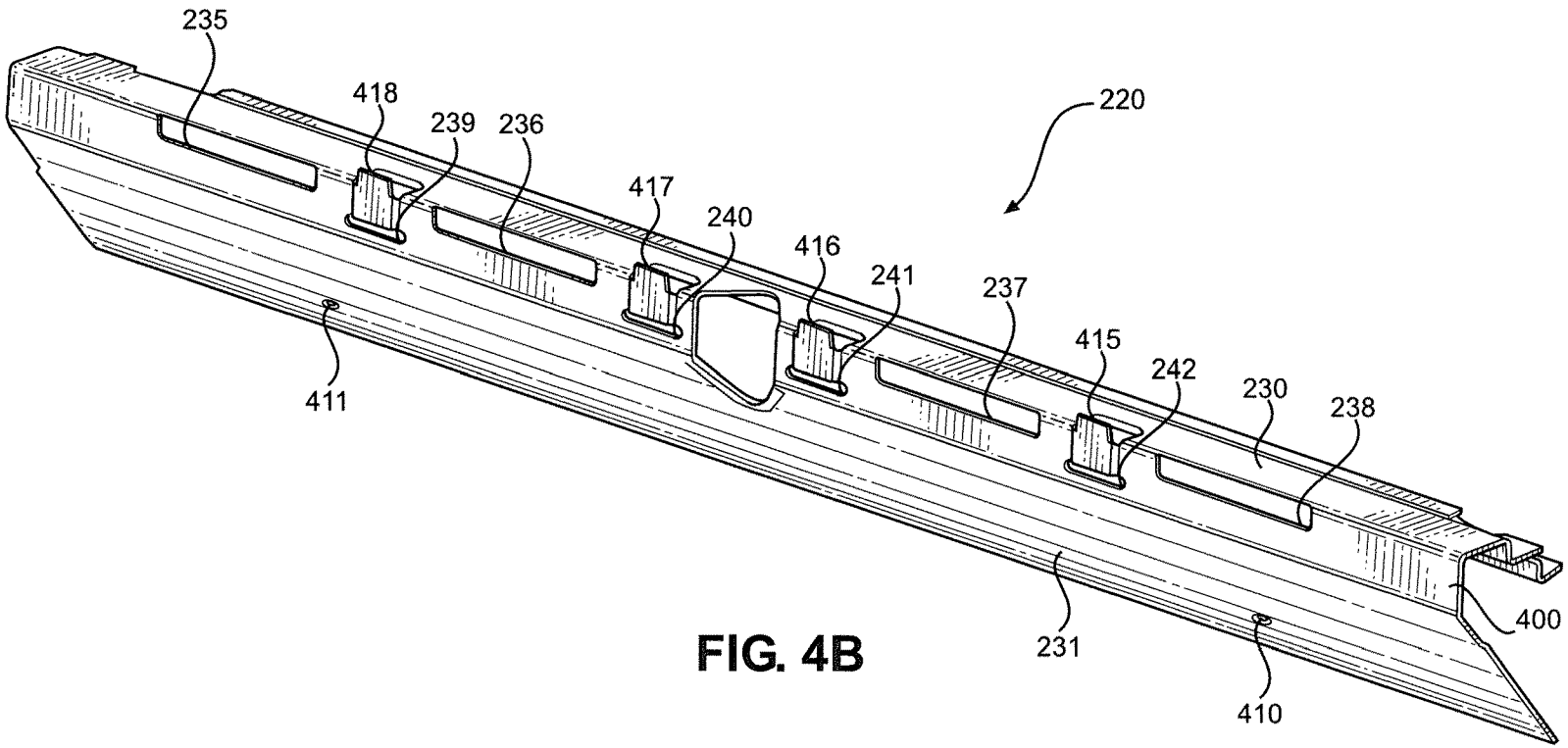
FIG. 4B is a front perspective view of the console heat deflector.

In FIGS. 4A and 4B, deflector 220 is shown independent of the rest of cooking appliance 100. As discussed above, duct 225 is defined between upper wall 230 and lower wall 231 of deflector 220. Upper wall 230 is shown to be stepped and effectively serves as a bottom wall of console 120, limiting the amount of air that can pass into console 120 from below. Lower wall 231 is angled forward, i.e., lower wall 231 slopes downward from the rear of cooking appliance 100 toward the front of cooking appliance 100. Accordingly, air impinging on lower wall 231 from the front is directed to holes 235-242, while air impinging on lower wall 231 from the rear is deflected rearward. Deflector 220 further includes a rear wall 400 connecting upper wall 230 to lower wall 231, hole 235-242 being formed in rear wall 400. To couple deflector 220 to the rest of cooking appliance 110, deflector includes mounting holes 405-408 in upper wall 230, mounting holes 410 and 411 in lower wall 231 and tabs 415-418. Specifically, deflector 220 is directly coupled to console 120 via mounting holes 405 and 406, to legs 130 and 131 via mounting holes 407 and 408, to diffuser 215 via mounting holes 410 and 411 and to back panel 145 via tabs 415-418. Although not shown, fasteners are inserted into mounting holes 405-408, 410 and 411 to accomplish this coupling, while tabs 415-418 are inserted into holes 179-182.

In summary then, the hot air generated within oven cavity 110 exits flue 210 or flue 300, impinges on diffuser 215 and mixes with the relatively cooler air being drawn upward from the lower portions of cooking appliance 100 such that the temperature of the combined airflow is lower than the temperature of the hot air exiting flue 210 or flue 300. As this air is exhausted out of the rear of cooking appliance 100, the relatively cooler air above cooktop 105 is permitted to be drawn through duct 225 and passes through holes 235-242. Since duct 225 is located between console 120 and the path along which the exhaust travels (e.g., first airflow path 200), console 120 is protected from the heat of the exhaust. Once the relatively cooler air passes through holes 235-242 and holes 175-182, it mixes with the exhaust such that the temperature of the combined airflow is lower than the temperature of the exhaust. As a result, the temperature of console 120 is reduced without the air behind cooking appliance 100 becoming unacceptably hot. This overall temperature control has various particular advantages, for example now enabling a color touchscreen to be used in user interface 135.

An exemplary cooking appliance was constructed in accordance with the present invention to demonstrate, among other things, that the area behind the cooking appliance does not become unacceptably hot. The resulting data is shown below in Table 1. In particular, each cell represents a temperature probe location behind the cooking appliance, with the leftmost column corresponding to the leftmost probes and the rightmost column corresponding to the rightmost probes (when the cooking appliance is viewed from the front). Similarly, the uppermost row corresponds to the uppermost probes and the lowermost row corresponds to the lowermost probes. Each of the cell values represents the difference between a limit temperature (90° C.) and an actual temperature at that location in degrees Celsius. Accordingly, the actual temperature at position A1, for example, is 62.1°

C. The data in Table 1 demonstrates that the temperature behind the cooking appliance does not exceed the limit temperature of 90° C. at any location and is, in fact, well below 90° C. at nearly every probe location.

TABLE 1

| | A | B | C | D | E | F | G |
|---|---|---|---|---|---|---|---|
| 1 | 27.9 | 11.9 | 17.5 | 30.2 | 1.0 | 18.3 | 26.5 |
| 2 | 48.1 | 44.8 | 45.7 | 45.7 | 41.8 | 40.9 | 44.1 |
| 3 | 51.7 | 50.0 | 50.6 | 50.4 | 50.2 | 46.3 | 46.3 |
| 4 | 51.3 | 48.1 | 50.4 | 50.6 | 50.2 | 46.2 | 47.4 |
| 5 | 49.4 | 47.9 | 50.3 | 43.6 | 51.3 | 50.6 | 49.2 |
| 6 | 53.6 | 43.9 | 50.9 | 51.0 | 55.1 | 54.7 | 54.8 |

Although certain air has been described above as being cool or relatively cool, this air is actually typically at or above room temperature. In other words, the air need not be chilled. Instead, the air is simply substantially cooler than the hot air generated through use of oven cavity 110.

Based on the above, it should be readily apparent that the present invention provides a way to reduce the temperature of a console of a cooking appliance. Although described with reference to preferred embodiments, it should be readily understood that various changes or modifications could be made to the invention without departing from the spirit thereof. In general, the invention is only intended to be limited by the scope of the following claims.

The invention claimed is:

1. A cooking appliance comprising:

a cooktop;

an oven cavity;

a console including a user interface for the cooking appliance;

a flue through which air exiting the oven cavity passes;

a deflector configured to reduce heat transfer between the air exiting the oven cavity through the flue and the console, wherein the deflector includes an upper wall, a lower wall and a duct defined between the upper wall and the lower wall; and a back panel including a first hole, wherein the cooking appliance defines a first airflow path, air traveling along the first airflow path exits the flue and is deflected rearward through the first hole by the deflector, the cooking appliance defines a second airflow path, and air traveling along the second airflow path enters the duct from an area above the cooktop.

2. The cooking appliance of claim 1, wherein the air traveling along the first airflow path exits the flue and is deflected rearward through the first hole by the lower wall of the deflector.

3. The cooking appliance of claim 2, wherein:

the back panel further includes a second hole;

a gap is located between the cooktop and the console;

the gap connects the area above the cooktop to the duct; and the air traveling along the second airflow path enters the duct from the area above the cooktop through the gap before passing through the second hole.

4. The cooking appliance of claim 3, wherein:

the air traveling along the first airflow path travels upward along the back panel after passing through the first hole;

the air traveling along the second airflow path travels upward along the back panel after passing through the second hole; and the first hole is located below the second hole such that the air traveling along the first airflow path mixes with the air traveling along the second airflow path along the back panel.

5. The cooking appliance of claim 1, wherein the duct is located above the flue.

6. The cooking appliance of claim 5, wherein the duct is located between the flue and the console.

7. The cooking appliance of claim 5, wherein the deflector is directly coupled to the console and the back panel.

8. The cooking appliance of claim 1, further comprising a diffuser, wherein the air traveling along the first airflow path impinges on and then passes around or through the diffuser before being deflected rearward by the deflector.

9. The cooking appliance of claim 8, wherein the diffuser is configured to disperse the air traveling along the first airflow path along the width of the cooking appliance.

10. The cooking appliance of claim 9, further comprising a body, wherein the cooking appliance defines a third airflow path, and wherein air traveling along the third airflow path travels upward from an area defined between the body and the back panel, impinges on the diffuser and mixes with the air traveling along the first airflow path.

11. The cooking appliance of claim 9, wherein the diffuser is directly coupled to the deflector.

12. A method of reducing a temperature of a console of a cooking appliance including a cooktop, an oven cavity, a flue through which air exiting the oven cavity passes, a deflector configured to reduce heat transfer between the air exiting the oven cavity through the flue and the console and a back panel including a first hole, wherein the console includes a user interface for the cooking appliance, and the deflector includes an upper wall, a lower wall and a duct defined between the upper wall and the lower wall, the method comprising:

causing air to travel along a first airflow path, wherein the air traveling along the first airflow path exits the flue and is deflected rearward through the first hole by the deflector; and causing air to travel along a second airflow path, wherein the air traveling along the second airflow path enters the duct from an area above the cooktop.

13. The method of claim 12, wherein the air traveling along the first airflow path is deflected rearward through the first hole by the lower wall of the deflector.

14. The method of claim 13, wherein the back panel further includes a second hole, a gap is located between the cooktop and the console, the gap connects the area above the cooktop to the duct, and the air traveling along the second airflow path enters the duct from the area above the cooktop through the gap before passing through the second hole.

15. The method of claim 14, wherein:

the air traveling along the first airflow path travels upward along the back panel after passing through the first hole;

the air traveling along the second airflow path travels upward along the back panel after passing through the second hole; and the first hole is located below the second hole such that the air traveling along the first airflow path mixes with the air traveling along the second airflow path along the back panel.

16. The method of claim 12, wherein:

the cooking appliance further includes a diffuser; and the air traveling along the first airflow path impinges on and then passes around or through the diffuser before being deflected rearward by the deflector.

17. The method of claim 16, further comprising dispersing the air traveling along the first airflow path along the width of the cooking appliance with the diffuser.

18. The method of claim 17, further comprising causing air to travel along a third airflow path, wherein the cooking appliance further includes a body, and wherein the air traveling along the third airflow path travels upward from an area defined between the body and the back panel, impinges on the diffuser and mixes with the air traveling along the first airflow path.

* * * * *